US005401354A

United States Patent [19]

Colucci

[11] Patent Number: 5,401,354

[45] Date of Patent: Mar. 28, 1995

[54] MULTI-PURPOSE CLAMPING APPARATUS

[76] Inventor: William G. Colucci, 1370 Park Ave., Long Beach, Calif. 90804

[21] Appl. No.: 123,874

[22] Filed: Sep. 20, 1993

[51] Int. Cl.[6] ..... B30B 15/00

[52] U.S. Cl. ..... 156/580; 269/6; 269/37; 269/41; 269/93

[58] Field of Search ..... 156/576, 580; 269/6, 269/37, 41, 93

[56] References Cited

U.S. PATENT DOCUMENTS

| | | | |
|---|---|---|---|
| 1,016,594 | 2/1912 | Woodman | 144/84 |
| 1,073,549 | 9/1913 | Wagner | 269/140 |
| 1,125,253 | 1/1915 | Barber | 29/256 |
| 1,766,230 | 6/1930 | Sea | 269/246 |
| 1,973,238 | 9/1934 | Walter | 269/101 |
| 2,572,366 | 10/1951 | McGough | 269/165 |
| 2,896,300 | 7/1959 | Arrighini et al. | 249/194 |
| 2,941,557 | 6/1960 | Baprawski | 269/41 |
| 3,888,476 | 6/1975 | Barton | 269/41 |
| 4,421,591 | 12/1983 | DeLigt | 156/502 X |
| 4,475,726 | 10/1984 | Smith | 269/41 |
| 4,552,345 | 11/1985 | Benda et al. | 269/43 |
| 4,647,028 | 3/1987 | Yang | 269/139 |
| 4,753,426 | 6/1988 | Varkala | 269/53 |
| 4,926,722 | 5/1990 | Sorensen et al. | 81/487 |
| 4,995,935 | 2/1991 | Ganzberger | 156/499 |
| 5,005,449 | 4/1991 | Sorensen et al. | 81/152 |
| 5,135,207 | 8/1992 | Bleaney | 269/21 |
| 5,149,071 | 9/1982 | Oliveira | 269/43 |
| 5,161,787 | 11/1992 | Hobday | 269/6 |

OTHER PUBLICATIONS 2 pages of advertisements showing "Jorgensen" Mitre Clamp, Style 63; Adjustable Corner and Splicing Clamp, Style 91; and Adjustable Miter Box and Corner/Splicing Clamp, Style 90.

Page from *Fine WoodWorking* Aug. 1993, No. 101 regarding odd angled clamping.

*Primary Examiner*—David A. Simmons
*Assistant Examiner*—J. Sells
*Attorney, Agent, or Firm*—Fulwider, Patton, Lee & Utecht

[57] ABSTRACT

A multi-purpose clamping apparatus to join the confronting edges of two boards together during a gluing process having a pair of base plates, a central hub about which the base plates may be rotated, a rail projecting laterally from the hub on which one of the base plates is connected and a press mounted on one of the base plates and engaging the rail for drawing the base plates together. Respective clamps overlie the upper surface of the base plates.

15 Claims, 3 Drawing Sheets

MULTI-PURPOSE CLAMPING APPARATUS

BACKGROUND OF THE INVENTION

1. Field of the Invention

This invention relates to a multi-purpose clamping apparatus for pressing the confronting edges or ends of two boards or other components during a gluing process.

2. Description of the Prior Art

In the practice of woodwork crafting the occasion often arises where boards or other components of wood or composites or other man-made materials are to be joined together along proximate edges or ends to provide a composite frame, border or panel to be integrated into a piece of furniture or molding. For narrow slats and the like, conventional clamps and vises, having a bite sufficient to span the width of the boards or items being joined, are satisfactory to engage the opposite sides of such boards and press them firmly together at the edges to be joined. However, difficulty is encountered when the boards to be joined are collectively wider than the bite of a conventional vise. A challenge is also presented when the boards are to be joined endwise thus requiring gripping of the boards for application of compressive forces in the longitudinal direction. The challenges encountered are compounded when the boards to be joined are to project at various angles, such as 90° to one another. In practice, it is desirable to orient the components in edgewise contacting relation to secure the relative positioning so as to visually check the fit and then, if satisfactory, separate such components to space the components apart for access to the mating edges for application of glue while monitoring the relative component orientation for repeating the mating fit with the glued edges. Numerous differed devices have been proposed in effort to solve the problems encountered in joining wide boards together laterally, lay boards together endwise, and other boards together at various uncommon angles.

One such mechanical device for clamping together of the confronting edges of boards during a gluing process incorporates a vise-like bar-clamp having two jaws at opposite ends of a bar that draw together boards placed in-between as the jaws are drawn together in a screw-like action. These vise-like clamping devices must more or less vary in size in direct relation to the composite span of the boards to be joined. Where large boards, such as plywood or particle board, or odd shapes, such as round stock, are used, the task of aligning the boards and clamping the boards in-between bar clamps can be burdensome indeed.

One such clamping device proposed for joining wide boards edgewise includes a screw to draw two barrel nuts together that are inserted within pilot holes drilled into the boards. The joint is secured tightly by adjusting the screw between the two barrel nuts. While such a clamping device is not size dependent in relation to the scale of the boards, the device does require that pilot holes be drilled into the surface of the boards in order to secure barrel nuts. Drilling of these holes requires care and skill to avoid unwanted damage such as accidental drilling through to the opposite face and in any event leaves the unsightly holes visible in the finished product themselves. Moreover such devices are not adaptable for practical use in joining oddly configured components such as round stock or cylindrically shaped molding.

Finally, for smaller pieces, an adjustable corner and splicing clamp has been employed consisting of a pair of vise-like clamps adjustably mounted on a protractor for clamping miter or butt joints at any selected angle as required. In a device of this type, the two vises are rotated into position along the protractor and the boards may be secured at their widths by the vises. While such devices work well for picture frames and the splicing of molding and trim, the vise clamps prove inadequate for securing larger boards together.

Wood workers have from time to time been forced to rely on trial and error techniques which often include extensive shaving or sanding of the confronting edges prior to the application of glue to the confronting edges.

None of the clamping devices or techniques of the prior art offer a practical device allowing for alignment of the boards to be glued to establish the desired orientation and alignment and then for separation to expose the confronting edges for application of glue or other bonding material while monitoring such established orientation and alignment for pressing of such boards back together without requiring that the boards be realigned.

Thus a need exists for a universal clamping device that maybe applied to different sizes and configurations of components to be joined together, that does not affect or intrude upon the fit or the integrity of the boards and allows for adjustment of the boards while maintaining their alignment.

SUMMARY OF THE INVENTION

The clamping apparatus of the present invention is characterized by a pair of base plates formed with upwardly facing support surfaces for securing a pair of respective components thereon during the process of gluing their confronting edges together wherein each base plate includes respective clamps to maintain the respective boards fixed against the base plates. Included between the two base plates is a rail that couples the first and second base plates together and permits movement of the second base plate therealong permitting the two base plates, with the components affixed therein, to be separated apart for access of glue to the edges, and then to be pressed together without disturbing alignment of such components. A trigger shaped press, mounted on the second base plate, when actuated, incrementally draws the second base plate along the rail towards the first base plate firmly pressing the confronting edges of the two boards clamped thereon together. The present invention provides the opportunity to refine the confronting edges of the components and apply the glue after the boards have been securely aligned in the clamp. Once glue has been applied to the components, the press is actuated to draw the confronting edges together.

It is a further object of this invention to permit the clamping apparatus to pivot the base plates about a pivot axis to allow for the angular displacement of the base plates to be adjusted according the joint angle formed by the connection of the two components.

Other objects and features of the invention will become apparent from consideration of the following description taken into connection with the accompanying drawing.

DESCRIPTION OF THE PREFERRED EMBODIMENT

Figure 1:
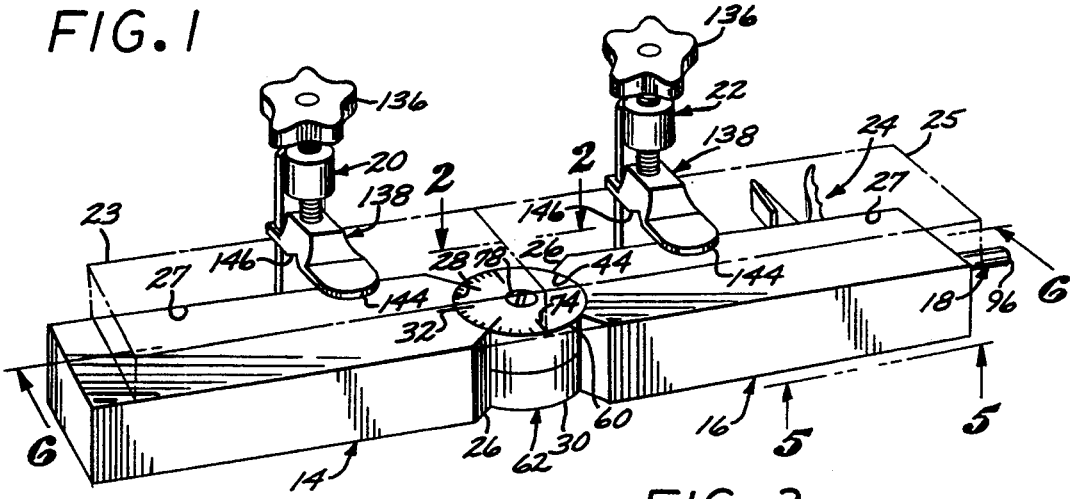
FIG. 1 is a perspective view of a clamping apparatus embodying the present invention.
Figure 2:
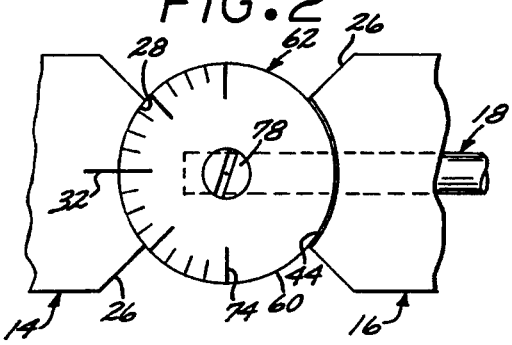
FIG. 2 is a partial top plan view, in enlarged scale, taken along line 2—2 of FIG. 1.

Referring to FIG. 1, the clamping apparatus of the present invention includes, generally, a pair of base plates 14 and which may be of a generally rectangular brick-like shape and pivotally connected together along an elongated rail 18 on which plate 16 slides. The base plates support respective upstanding C-clamps, generally designated 20 and 22, for selectively clamping components such as boards 23 to the respective top surfaces of such base plates 14 and 16. A friction press, generally designated 24, mounted in the base plate 16 controls movement of such plate relative to the base plate 14 and is operative to provide a mechanical advantage in selectively driving base plate 16 and, consequently, a component clamped thereon, toward the base plate 14. Thus, the plates 14 and 16 may be adjusted to a selected position such as that shown on FIG. 1 and components such as flat boards 23 and 25 positioned thereon in contacting edgewise relations, the clamps 20 and 22 closed to secure such components in relative mating position on such base plates. The press 24 may then be released to free the base plate 16 to slide on the rail 18 away from base plate 14 to expose the confronting edges of such components for application of glue. The base plate 16 may then be slid freely back on the rail 18 to shift the component 25 back into mating contact as previously established with component 23. The press 24 may then be activated to press the plate 16 toward the plate 14 to thoroughly press the edges of the components 23 and 25 firmly together while maintaining the previously established relationship.

The main support for the components 23 and 25 is provided by the base plates 14 and 16 that consist of rectangular wooden blocks having an overall brick-like shape tapered at the corners of their proximal ends to form respective chamfers 26. The upper surface 27 of each of the blocks is textured or coated with a grit matting to prevent sliding of the components when placed on the blocks. The wooden blocks provide a firm rigid support surface for the components 23 and 25 that is lightweight and easy to manufacture. The use of wooden base plates also reduces the risk of damage to components 23 and 25 due to scratching during mounting of the components as would be encountered with metal base plates. Each of the base plates 14 and 16 include tapered corners 26 at their respective confronting proximal ends thereby reducing the surface area of the proximal end.

With reference to FIGS. 1–4, 6 and 8, the first base plate 14 is formed at one extremity with a semi-cylindrical concavity 28 carved out of the upper half and a cylindrical tongue 30 projecting from the lower half and configured with the same radial center point as that of the concavity 28. On the upper surface of the first base plate 14, a central pointer mark 32 extends longitudinally to the edge of the concavity end to visibly identify the center point of the concavity 28. At the radial center point of the tongue, a bore hole 34 extends through the center of the tongue with a counter bore 36 on the underside of the tongue. A threaded bore hole 38 (FIG. 6) is drilled through the tongue at a point half way between the counter bore 36 and the proximal end 28 of the first base plate 14. The bore hole 38 threadably receives a set screw 40 terminating at its upper extremity in an index tip 42 projecting about the top surface of such tongue.

It will be appreciated that the function of the index screw is only to establish a positive angular relationship between the base plates 14 and 16 and may take many different forms. The threaded bore 38 could be in the form of a blind bore drilled at the same location in the upper surface of the tongue and housing an open ended barrel having a retainer rim about the open end to retain a spring loaded index ball to be pressed into selective engagement with indents.

Figure 5:
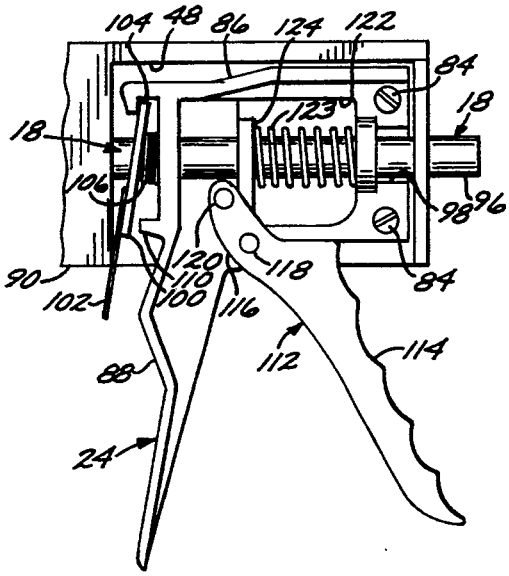
FIG. 5 is a transverse sectional view in enlarged scale, taken along line 5—5 of FIG. 1.
Figure 6:
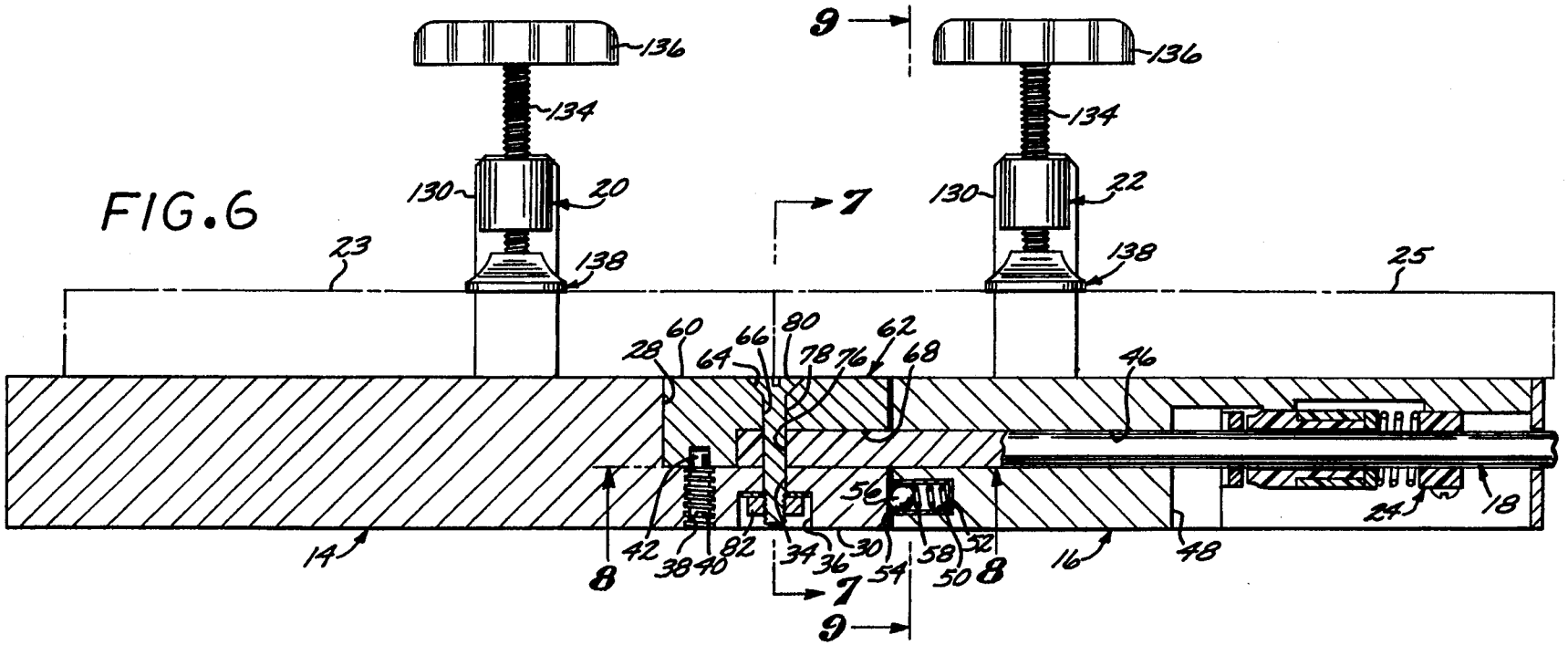
FIG. 6 is a longitudinal front sectional view, in enlarged scale, taken along line 6—6 of FIG. 1.

With continued reference to FIGS. 1–4, 6 and 8, the proximal end of a second base plate 16 is shaped with a cylindrical concavity 44 that complements the curvature of the end of the cylindrical tongue 30 to be abutted thereagainst. Formed centrally along the longitudinal axis of base plate 16 is an open ended slot 46 (FIG. 6). The slot 46 may be of either rectangular or cylindrical in cross section. The distal extremity of the plate 16 is hollowed out to form a downwardly opening clamp chamber 48 (FIGS. 5 and 6).

Referring to FIG. 6, a blind bore 50 is drilled longitudinally into the proximal end of the plate 16 centrally in the concavity 44 aligned under the slot 46 to receive an open ended barrel 52 having a retainer rim 54 about the open end. A ball bearing 56 is housed in the barrel to be biased against the rim 54 by means of a bias spring 58.

A cylindrical disk 60 (FIGS. 1 and 6) having the same thickness and diameter as the tongue 30 of the first base plate 14 overlies the tongue and cooperates therewith to form a central hub 62. From a counter sunk cavity 64 on the upper side of the disk 60, a bore hole 66 extends through the cylindrical center of the disk and aligns with the bore hole 34 in the tongue 30. On the underside of the disk 60, a diametrical, open ended mortise 68 is carved to align with the end of the slot 46 (FIG. 6).

Figure 8:
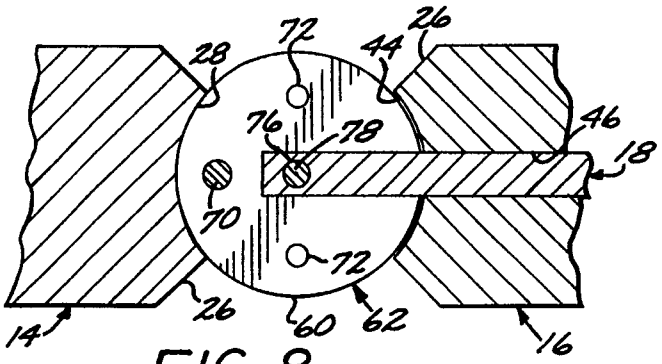
FIG. 8 is a partial longitudinal sectional view, taken along line 8—8 in FIG. 6.
Figure 7:
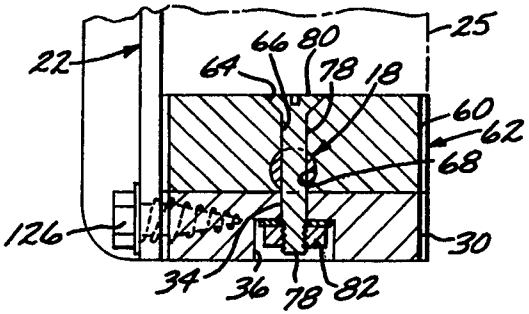
FIG. 7 is a transverse sectional view, in enlarged scale, taken along line 7—7 of FIG. 6.
Figure 9:
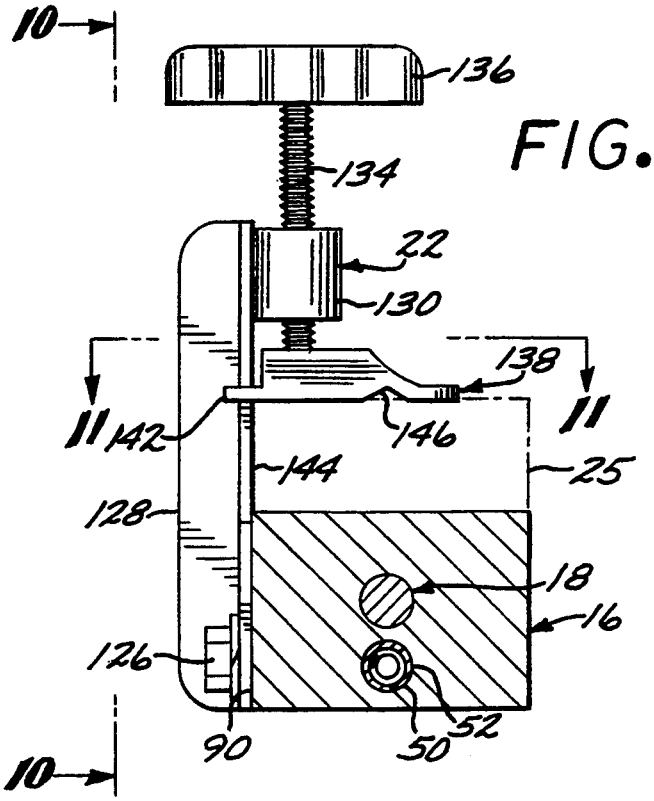
FIG. 9 is a transverse sectional view taken along line 9—9 of FIG. 6.
Figure 10:
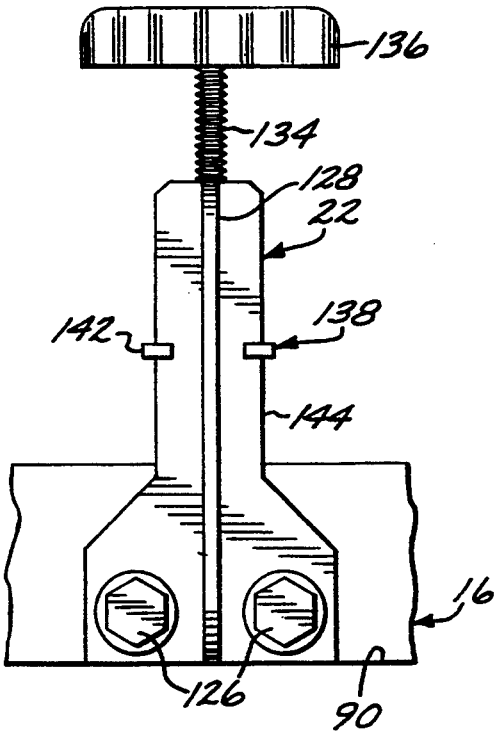
FIG. 10 is a partial back view taken along line 10—10 of FIG. 9.
Figure 11:
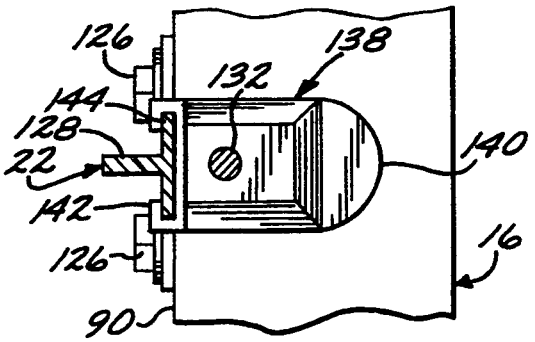
FIG. 11 is a longitudinal top view taken along line 11—11 of FIG. 9.

Referring to FIG. 8, a plurality of index bores 70 and 72 are drilled into the underside of the disk and correspond to predetermined angular locations 90', 180' and 270' with respect to the radius formed by the mortise 68. The index bores 70 and 72 are all drilled on the same radius as the threaded bore 38 in the tongue 30 of base plate 14 so the set screw will, when clocked to the appropriate position, align therewith. Referring to FIGS. 1–4, protractor indicia 74 is printed about the periphery of the top side of the disk 60 to register with the pointer 32.

The tension rail 18 telescopes from the tensioning chamber 48, through the slot 46 (FIG. 6) and into the mortise 68 and is formed with a bore 76 aligned with the tongue bore 34 and disk bore 66. A bolt 78 extends through the bores 66, 76 and 34 such that the head 80 of the bolt nests in the counter sunk cavity 64 in the disk 60 and a nut 82 is threadably secured to the bolt, housed in the counter sunk cavity 36 on the underside of the tongue. Although firmly secured, the rod 18 and disk 60 are free to pivot about the central bore hole with respect to the base plate tongue 30.

A pistol-handled friction press 24 (FIG. 5) is housed in the chamber 48 of the base plate 16 and secured by a pair of wood screws 84. While friction press 24 may take many different forms, the one selected for illustration is similar in design to the trigger presses found on commercially available caulking guns. A rectangular frame 86 is housed within the chamber 48 formed at the backside proximal corner with a pistol handle 88 that extends laterally out of the backside opening 90 in the cavity. The rectangular frame 86 includes a thick rim 92 that extends from the free end of the handle 88 along the proximal end of the frame to the front side distal corner 94 of the frame opposite from where the handle begins. When viewed laterally, the handle and rim combine to exhibit a T-shape appearance that structurally enhances the handle to withstand the torque forces applied to it by the craftsman's grasp. The rim side of the handle is contoured to ease in gripping the handle. The rod 18 is inserted through the proximal end of the second base plate with the free end 96 of the rod 18 extending out the distal end. The rectangular frame 86 receives the rod 18 through a longitudinal slot 98 formed in the frame where at the receiving end of the frame a spring biased friction latch 100 and release 102 is secured to the frame by an overhanging lip 104 or J-hook projecting longitudinally away from the front side corner of the frame 86. The friction latch 100 includes a vertically extended oval shaped aperture (not shown) with a lower edge that is biased by a spring 106 to frictionally grip the underside 108 of the rod to prevent withdrawal of the second base plate toward the free end of the rod. A latch release 102 is connected to the friction latch 100 with a free end that extends out of the second base plate 16 in spaced apart relation to the handle 88 such that, when sufficient pressure to counter the spring bias is applied to the release 102, the lower end of the friction latch 100 is drawn towards the handle thus freeing the rod from the lower edge of the aperture. A release stop 110 extends horizontally out of the lower corner of the frame to stop the friction latch at the point where the rod is freed therefrom.

A trigger 112 (FIG. 5) pivotally carried from the frame near the base of the handle includes a trigger grip 114 molded with finger contours that diverges out from the handle base such that the free end of the trigger 112 is in spaced apart relation with the free end of the handle 88. Side supports 116 on the trigger slide over opposite sides of the frame 86 and a cross-member 118 pivotally connects the trigger to the frame. A second cross member 120 bolts to the free ends of the trigger side supports 116. A spring biased friction press 124, located within an aperture 122 in the frame 86, is biased against the second cross member 120 by a spring 123 and receives the rod through a vertically extended oval aperture in the friction press.

Referring to FIGS. 1 and 9–11, respective upstanding C-clamps 20 and 22 are mounted on the base plates by a pair of bolts 126 securing the respective clamps 20 and 22 to the base plates 14 and 16. With reference to the second base plate clamp 22, an upstanding T-shaped neck 128 rises above the upper surface of the base plate 16 onto which a boss 130 is mounted in overlying relation to the upper surface 27 of the base plate. The boss 130 includes a threaded bore 132 (FIG. 11) supporting a screw 134 therein. A handle 136 (FIG. 9) is attached to the upper end of the screw and a foot 138 couples to the lower end of the screw. The foot is generally in the shape of a horizontal tombstone (FIG. 11) having a rounded front end 140 to receive wood stock 25 without damaging the wood stock against sharp corners. Carried from the rear end of the foot a pair of rearwardly projecting inturned cleats 142 slidingly capture the outer edges 144 of the upstanding neck. Formed in the underside of the foot, a V-groove 146 extends width-wise across the foot to accommodate the periphery of round stock, alternatively the grooves could be formed in the top surface of the underlying base plates.

In operation, a wood worker must first prepare the clamping apparatus for the task at hand. If frames or oddly shaped components are to be joined, then the base plates 14 and 16 may be pivoted to the corresponding angle formed by the joined components 23 and 25. The base plates may be pivotally rotated to any angle within 90 degrees on either side of each other. The tapered clearance corners 26 on the proximate ends of the base plates 14 and 16 allow this increased range of rotation about the hub 62. The index mark 32 and protractor indicia 74 cooperate to allow the wood worker to exactly align the base plates 14 and 16 to the necessary joint angle. Once the angle between the base plates has been achieved, the angle may be secured by rotating the set screw 40 until its tip 42 contacts the disk 60 above the tongue 30. Index bores 70 and 72 in the disk 60, located at the most often used pivot angles, receive the tip 42 of the set screw 40 thereby locking the angular displacement of the base plates securely in the selected angle. Once the desired angle has been selected, the release 102 on the second base plate 16 is drawn towards the handle 88 of the friction press 24 to allow the rail 18 to telescope freely through the second base plate 16 thus allowing the second base plate 16 to be adjusted in a slight spaced apart relationship to the hub 62. Finally, the respective clamp handles 136 are rotated until each foot 138 is raised sufficiently away from the upper surface 27 of the base plates to receive the components 23 and 25 in between.

Once the clamping device has been properly adjusted, the respective components 23 and 25 to be joined are placed on the textured upper surface 27 of the base plates. The confronting edges are positioned in contact with one another and the C-clamps 20 and 22 are closed to secure the respective components against the upper surface 27 of the base plates 14 and 16. It will be appreciated that the spacer ball 54 will serve to maintain the base plate 16 spaced distally from the tongue 30 and hub disk 32 by about 1/16 of an inch even though the edges of the boards 23 are in intimate contact. The press may be released so the plate 16 can be freely slid thereon away from the plate 14 to space the adjacent edges of the boards 23 and 25 apart so ready access can be had thereto. Glue may then be applied to the spaced apart edges of the board and the friction press 24 actuated to release the grip on the rail 18 to free the plate 18 so it can be slid toward the hub. The press may then be operated to incrementally draw the base 16 toward the plate 14 thus retracting the spacer ball 54 into the barrel 50 (FIG. 6) to provide for the components 23 and 25 to be drawn firmly together. By incrementally drawing the base plates together, the craftsman is able selectively chose the necessary amount of pressure to be applied to the confronting edges of the respective components thereby insuring that all of the glue is not squeezed out of the joint by the clamping device. When the components have dried, the clamps 20 and 22 are opened and the joined components removed.

Figure 3:
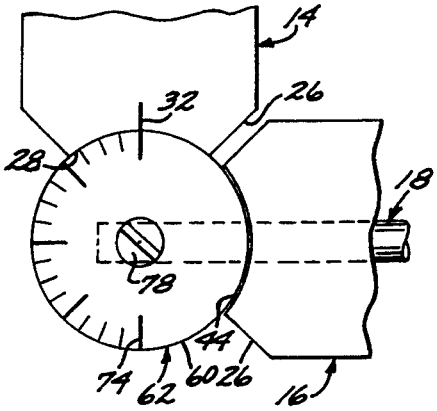
FIG. 3 is a top plan view similar to FIG. 2 showing the clamping apparatus rotated about its center axis.
Figure 4:
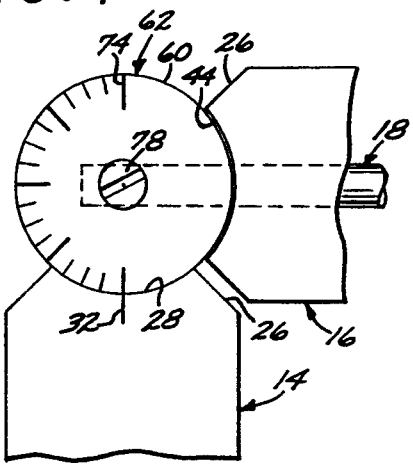
FIG. 4 is a top plan view similar to FIG. 2 showing the clamping apparatus rotated about its center axis opposite to FIG. 3.

It will be appreciated that with the articulation capability about the hub, the plate 16 may be selectively rotated about such hub to the position shown in FIG. 3 so that the respective clamps are positioned facing outwardly at 90° from one another. It will be appreciated by those skilled in the art that, in this orientation, the clamp apparatus may be conveniently fitted into the inside corner of, for instance, a frame with 90° corners to thus clamp the adjacent frame components by such clamp so they may be drawn together by the press. Similarly, in the orientation shown in FIG. 4, the clamps 20 and 22 will be facing inwardly so they may be clamped over the outside edges of 90° frame components so the press may be utilized to draw such components together from the outside.

From the foregoing, it will be apparent that the clamp apparatus of the present invention is economical to make, convenient to operate and effective to provide for effective pressing together of odd configured or particularly wide components.

Various modifications and changes may be made with regard to the foregoing detailed description without departing from the spirit of the invention.

What is claimed:

1. Clamping apparatus for pressing the confronting edges of first and second components together during a gluing process and comprising:

first and second base plates formed with upwardly facing support surfaces for supporting the respective said first and second components with said edges confronting one another;

a rail carried on one end from said first base plate and slidably coupled with said second base plate for movement of said second base plate therealong relative to said first base plate;

a spacer device interposed between said first and second base plates including an open ended bore formed in said second base plate opening toward said first base plate, a roller ball in said bore and a coil spring in said bore for pressing said ball toward said first base plate to engage said first base plate and maintain said plates normally biased a predetermined distance apart;

a press device mounted on said second base plate engaged with said rail and operative upon actuation thereof to overcome the bias of said spring and draw said base plates firmly together; and first and second clamps on the respective said first and second base plates for clamping said first and second components to the respective said support surfaces with said confronting edges securely aligned together, whereby said second base plate may be positioned on said rail in close spaced relation with said first plate and said first and second components placed on the respective said support surfaces and clamped to establish an orientation of said components relative to one another and said second plate then slid along said rail away from said first plate to expose said confronting edges for application of glue thereto and thereafter said second base plate may be slid on said rail toward said first base plate and press device operated to overcome said bias and draw said base plates positively toward one another to press said confronting edges firmly together.

2. Clamping apparatus as set forth in claim 1 wherein: said clamps include clamp pads formed with downwardly opening V-grooves for accommodating round stock.

3. Clamping apparatus as set forth in claim 1 wherein: said press device includes a friction latch device, a pistol grip handle and a trigger coupled to said rail and operable to draw and hold said first and second base plates together.

4. Clamping apparatus as set forth in claim 1 that includes:

textured layers on said first and second support surfaces to reduce slippage of the component clamped thereon.

5. Clamping apparatus for pressing the confronting edges of first and second components together during a gluing process and comprising:

first and second base plates formed with upwardly facing support surfaces for supporting the respective said first and second boards with said edges confronting one another;

a rail connecting said first and second base plates together for movement therealong relative to one another;

a press device coupled between said base plates operable draw said base plates together;

a hub interposed between said first and second base plates;

pivot means to provide for pivoting of said first base plate about said hub so that said first base plate may be pivoted to different selected angels relative to said first base plate;

first and second clamps on the respective said first and second base plates for clamping said first and second boards to the respective said support surfaces wherein said confronting edges maybe securely aligned together, wherein said first and second boards placed on said support surfaces and clamped maybe spaced apart so that glue may be placed on said confronting edges and thereafter said press device operated to draw to said base plates together to press said confronting edges firmly together.

6. Clamping apparatus as set forth in claim 5 wherein: said clamps include clamp pads formed with downwardly opening V-grooves for accommodating round stock.

7. Clamping apparatus as set forth in claim 5 wherein: said press device includes a friction latch device, a pistol grip handle and a trigger coupled to said rail and operable to draw and hold said first and second base plates together.

8. Clamping apparatus for pressing the confronting edges of first and second components together during a gluing process and comprising:

first and second base plates formed with upwardly facing support surfaces for supporting the respective said first and second components with said edges confronting one another;

a rail carried on one end from said first base plate and slidably coupled with said second base plate for movement of said second base plate therealong relative to said first base plate;

a hub interposed between said first and second base plates;

pivot means to provide for pivoting of said first base plate about said hub so that said first base plate may be pivoted to different selected angles relative to said first base plate;

a press device mounted on said second base plate engaged with said rail and operative upon actuation thereof to draw said base plates firmly toward one another together; and first and second clamps on the respective said first and second base plates for clamping said first and second components to the respective said support surfaces with said confronting edges securely aligned together, whereby said second base plate may be positioned on said rail in close spaced relation with said first plate and said first and second components placed on the respective said support surfaces and clamped to establish an orientation of said components relative to one another and said second plate then slid along said rail away from said first plate to expose said confronting edges for application of glue thereto and thereafter said second base plate may be slid on said rail toward said first base plate and press device operated to draw said base plates positively toward one another to press said confronting edges firmly together.

9. Clamping apparatus according to claim 8 wherein;

said pivot means includes a pivot pin connecting said rail to said hub.

10. Clamping apparatus according to claim 8 that includes:

protractor indicia on said hub;

a pointer on said first base plate for cooperation with said indicia.

11. Clamping apparatus according to claim 8 wherein:

said hub includes a hub disk mounted on said first base plate and formed separate from said second base plate.

12. Clamping apparatus according to claim 8 wherein:

said hub is formed from a cylindrical disk, said first base plate is formed with a hub tongue projecting toward said second base plate and cooperating with said first plate to form thereon a disk receiving cavity, at least partially cylindrical in shape, having an underside confronting said tongue, said underside of said disk being formed with indexing indentations spaced at selected angular locations thereabout; and index means mounted on said tongue for selectively engaging said indentations.

13. Clamping apparatus according to claim 12 wherein:

said index means includes a threaded bore formed in said tongue, a set screw in said threaded bore, wherein said set screw may be positively biased against said disk.

14. Clamping apparatus according to claim 12 wherein:

said hub is formed from a cylindrical disk having an underside confronting a semi-cylindrical tongue projecting from said first base plate;

said pivot pin includes formed from a nut and a bolt connects said disk to said tongue and selectively may be adjusted to positively bias said disk against said tongue; and index means mounted on said tongue for selective engagement with said disk to stop rotation of said disk relative to said tongue.

15. Clamping apparatus according to claim 5 wherein:

said first and second base plates are formed with tapered corners at the respective proximal ends to increase the range of angular displacement between said first and second base plates.

* * * * *